US007555876B2

(12) United States Patent
Drenguis et al.

(10) Patent No.: US 7,555,876 B2
(45) Date of Patent: Jul. 7, 2009

(54) DEVICE FOR COVERING PACKAGING GROUPS

(75) Inventors: Alfred Drenguis, Börnsen (DE); Michael Wegmann, Hamburg (DE); Andreas Storcks, Südlohn-Oeding (DE)

(73) Assignee: Focke & Co. (GmbH & Co. KG), Verden (DE)

( * ) Notice: Subject to any disclaimer, the term of this patent is extended or adjusted under 35 U.S.C. 154(b) by 68 days.

(21) Appl. No.: 11/575,731

(22) PCT Filed: Sep. 17, 2005

(86) PCT No.: PCT/EP2005/010065

§ 371 (c)(1),
(2), (4) Date: Mar. 21, 2007

(87) PCT Pub. No.: WO2006/032428

PCT Pub. Date: Mar. 30, 2006

(65) Prior Publication Data

US 2008/0134636 A1 Jun. 12, 2008

(30) Foreign Application Priority Data

Sep. 23, 2004 (DE) ..... 10 2004 046 576

(51) Int. Cl.
*B65B 49/12* (2006.01)

(52) U.S. Cl. ..... 53/234; 53/206; 53/220; 53/222; 53/225; 53/228; 53/232

(58) Field of Classification Search ..... 53/466, 53/203, 206, 210–211, 216, 220–225, 228–234
See application file for complete search history.

(56) References Cited

U.S. PATENT DOCUMENTS

| | | | | |
|---|---|---|---|---|
| 4,624,096 | A * | 11/1986 | Nordstrom | 53/209 |
| 5,189,864 | A * | 3/1993 | Cinotti et al. | 53/439 |
| 5,269,117 | A | 12/1993 | Boriani et al. | |
| 5,755,080 | A * | 5/1998 | Draghetti et al. | 53/466 |
| 6,164,041 | A * | 12/2000 | Focke et al. | 53/448 |
| 6,640,522 | B2 * | 11/2003 | Antoniazzi et al. | 53/466 |

FOREIGN PATENT DOCUMENTS

| | | | |
|---|---|---|---|
| DE | 3433428 | A1 | 3/1986 |
| DE | 103 10 451 | A1 | 9/2004 |
| EP | 0 860 358 | A | 8/1998 |
| EP | 1 262 408 | A | 12/2002 |
| WO | WO 99/47422 | | 9/1999 |
| WO | WO 01/28855 | A1 | 4/2001 |

OTHER PUBLICATIONS

International Search Report (EPO).
DE Search Report (Germany).

* cited by examiner

*Primary Examiner*—Christopher Harmon
(74) *Attorney, Agent, or Firm*—Laurence P. Colton; Smith, Gambrell & Russell

(57) ABSTRACT

For the purpose of wrapping articles, in particular groups (19) of packs, in a blank (10), use is made of a folding turret (21) having a single pocket (23) passing through its diameter. Lateral boundaries of the pocket (23) comprise belts (30, 31) which, upon introduction of a group (19) of packs with blank (10), can be moved in the pushing-in direction and which butt in a friction-free manner against legs (27, 28) of the blank (10), which is folded in a U-shaped manner. A block-form stop component (37) can be moved within the pocket (23) from one end position to the other.

17 Claims, 7 Drawing Sheets

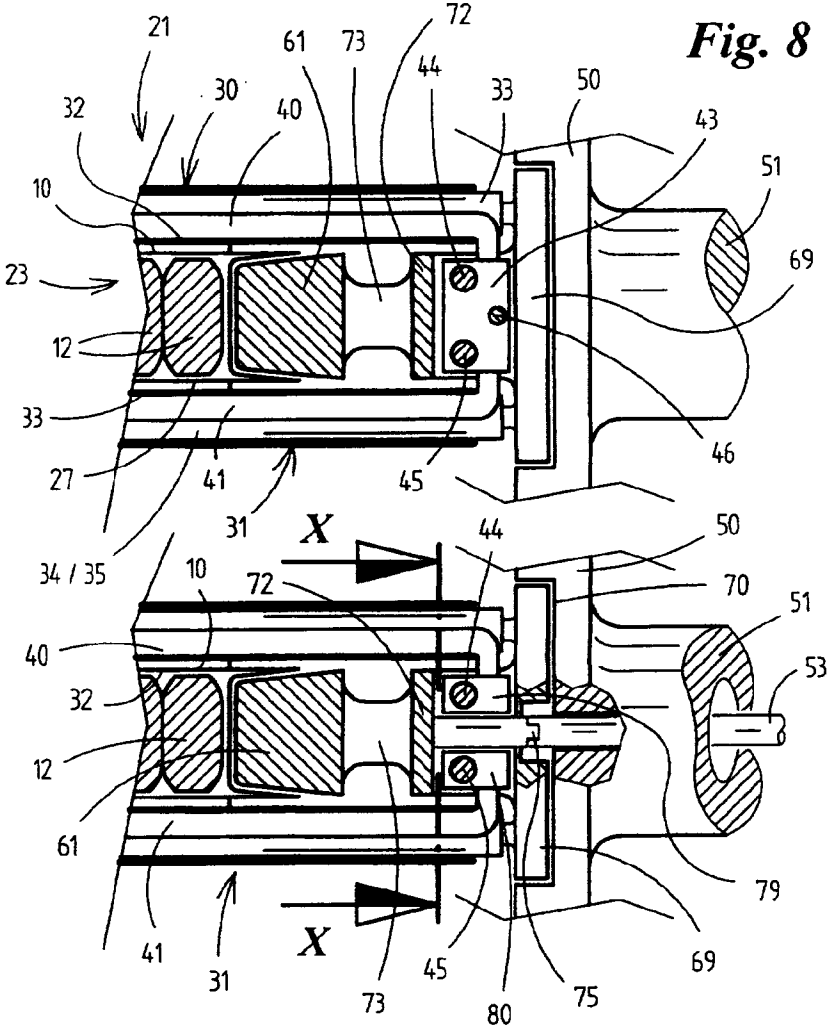
Fig. 8
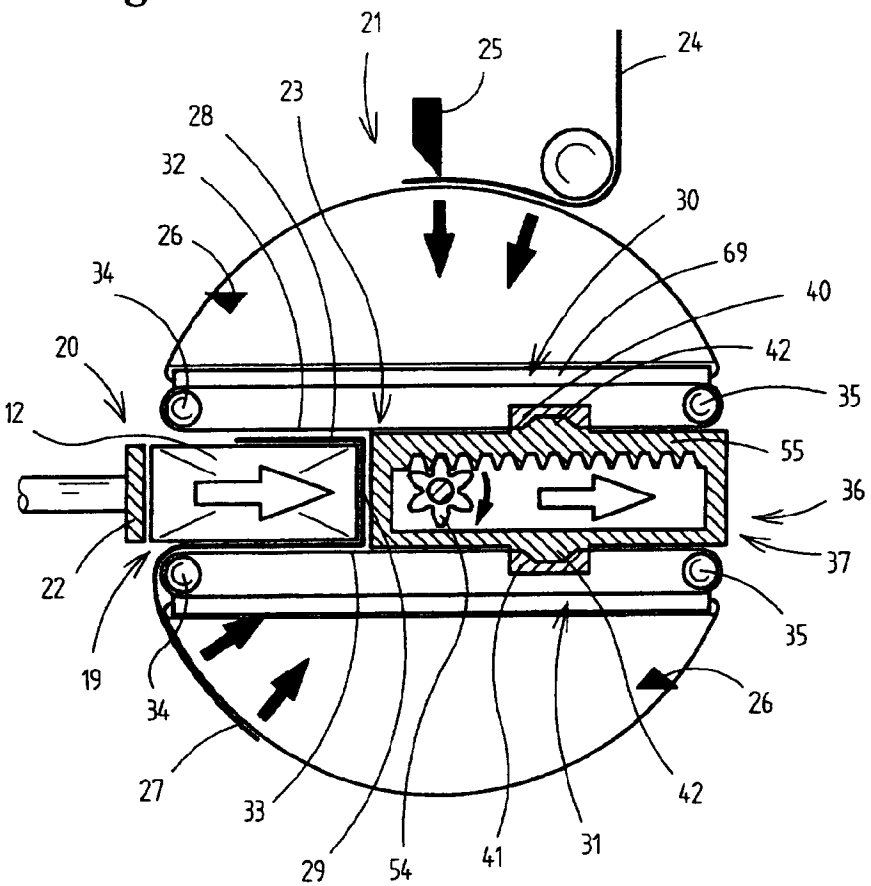
Fig. 7
Fig. 9

DEVICE FOR COVERING PACKAGING GROUPS

STATEMENT OF RELATED APPLICATIONS

This patent application is the Patent Cooperation Treaty Chapter II National Phase in the United States of America of International Application No. PCT/EP2005/010065 having an International Filing Date of Sep. 17, 2005, which in turn claims priority on German Patent Application No. 10 2004 046 576.2 having a filing date of 23 Sep. 2004.

BACKGROUND OF THE INVENTION

1. Technical Field

The invention relates to an apparatus for wrapping articles, in particular packs or groups of packs, having at least one outer-wrapper blank, it being possible for the article to be pushed into a receiving means of a folding apparatus, in particular into a pocket of a rotatable folding turret, with the blank being carried along in the process, and for the blank to be folded around the article In a U-shaped manner during the pushing-in movement.

2. Related Art

The operation of wrapping packs or groups of packs with a blank is one of the standard tasks performed in packaging technology. It is customary for the blank, severed from a material web, to be held ready at the entry side of the receiving means or pocket and to be positioned on the pack to form a U-shaped sub-wrapper. In the case of large-surface-area articles or relatively large groups of packs or packs of relatively low dimensional stability, e.g. bags of tobacco, skewed positioning, warping, etc. may occur in the region of the blank during the pushing-in operation, as a result of which a defective pack is produced.

BRIEF SUMMARY OF THE INVENTION

Accordingly, the object of the invention is to improve the operation of fitting an (outer-)wrapper blank on packs or groups of packs to the extent where precise positioning of the blank following the first folding step is ensured even in high-capacity packaging apparatuses.

In order to achieve this object, the apparatus according to the invention is characterized in that in the region of pocket walls running parallel to the pushing-in direction, preferably corresponding to a top side and underside of the pocket in the pushing-in position, the receiving means or pocket has conveying means which, during the pushing-in movement of the article and of the blank, can be moved in the pushing-in direction at a speed which corresponds approximately to the pushing-in speed.

The invention is based on the finding that precise folding of the blank can be achieved if those boundaries of the receiving means or pocket which butt against the blank are moved along correspondingly during the (pushing-in) movement.

A further special feature is that of a stop which can be moved within the receiving means or pocket being provided for a front pushing-in side, as seen in the pushing-in direction, of the article with abutting blank. This stop or a stop component further ensures that the blank butts correctly against the article.

The folding turret is a special design, having a receiving means or pocket which extends through its diameter and has its depth limited on an individual and alterable basis by the moveable stop component. The folding turret itself is designed as an exchangeable unit, so that, for format adaptation, the entire folding turret can easily be exchanged and, while drive and carrying units are maintained, folding turrets of different dimensions can be used for articles of different sizes.

BRIEF SUMMARY OF THE DRAWINGS

Further details of the invention are explained more specifically hereinbelow with reference to the drawings, in which:

FIG. 7 shows the apparatus according to FIG. 6 in vertical section along section plane VII-VII from FIG. 6.

FIG. 8 shows a detail of the folding apparatus according to FIG. 5 in axial vertical section along VIII-VIII from FIG. 5.

FIG. 9 shows an illustration analogous to FIG. 8 for the exemplary embodiment of FIG. 6, along section plane IX-IX.

DETAILED DESCRIPTION OF PREFERRED EMBODIMENTS

Figures 1, 2:
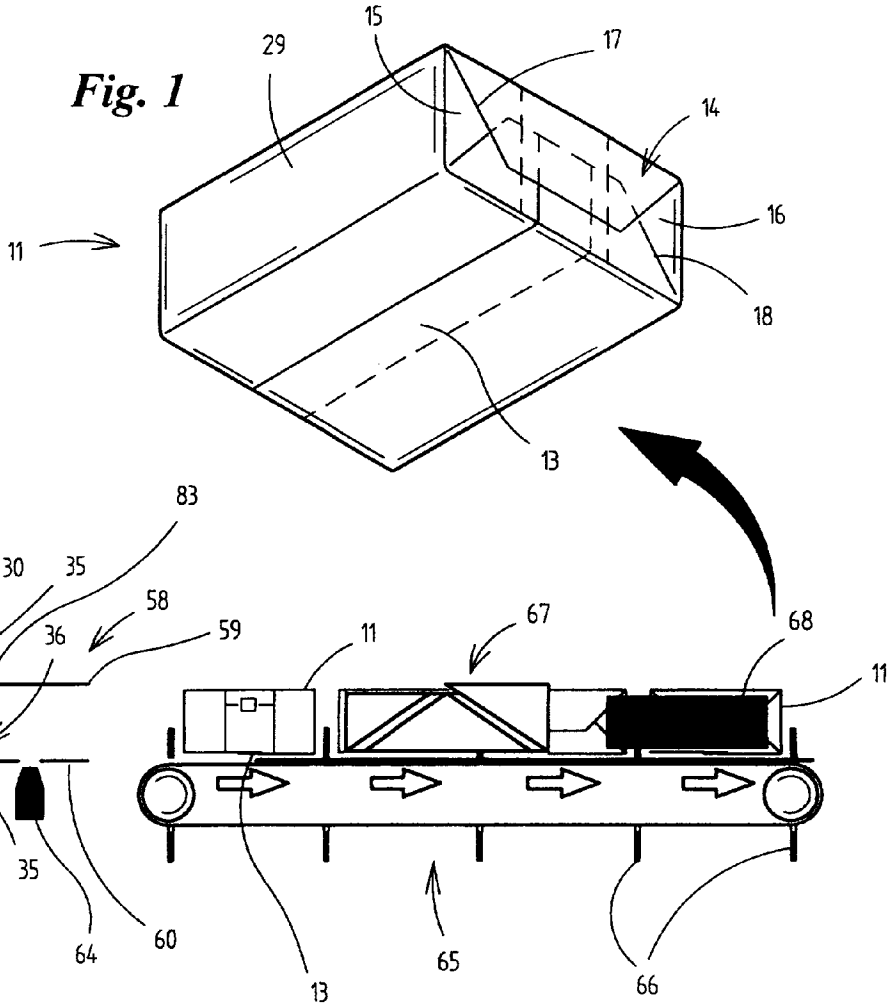
FIG. 1 shows a perspective view from beneath of a multipack following completion.
FIG. 2 shows a schematic side view of an apparatus for producing packs, one part being shown in vertical section.

Referring now to the figures, the invention is concerned with the operation of wrapping articles (fully) with a blank 10 in order to form an (outer) wrapper. In the case of the exemplary embodiments shown, the packs 11 produced are multipacks containing a plurality of individual packs. In this case, these are bag packs 12 for cut tobacco, that is to say individual packs of low dimensional stability. The bag packs 12 are arranged one beside the other in an upright position, to be precise with the longitudinal extent oriented in the conveying direction. The outer wrapper or the blank 10 is fitted so as to form a longitudinal overlap 13 or a "flexible-tube overlap" on a (bottom) side. Mutually opposite end sides 14 have an "envelope fold" with inner side flaps 15, 16 and outer, trapezoidal longitudinal flaps 17, 18.

In order to produce such a (multi)pack 11, a group 19 of packs, which has been produced and formed elsewhere, is held ready in the region of the pushing-in station 20 for being pushed into a folding apparatus, namely into a folding turret 21. The group 19 of packs is introduced into a receiving means of the folding turret 21, namely into a pocket 23, by a pusher 22. The blank 10 is held ready on the circumference of the folding turret 21 in order to be carried along by the group 19 of packs as they are pushed into the pocket 23.

The blank 10 is severed from a continuous material web 24, in particular film web. This is fed to the circumferential surface of the folding turret 24, which can be rotated about a horizontal axis, in a top region of this folding turret. Suction bores, which are arranged and act in a known manner, fix the material web 24 and the severed blank on the circumferential surface of the folding turret 21. The material web 24, which is directed over a deflecting roller on the circumference of the folding turret 21, is carried along by the folding turret 21. When a length of the material web 24 which corresponds to a blank 10 is butting against the circumference of the folding turret 21, the blank 10 is severed from the material web 24 by a severing device. The severing device comprises a fixed severing cutter 25, which is arranged above the folding turret, and a plurality of, namely two, diametrically opposite mating cutters 26 on the circumference of the folding turret 21. A severing cut is carried out when one of the revolving mating cutters 26 is located in the region of the severing cutter 25. The mating cutters 26 are arranged such that the severed blank is located in a desired relative position in relation to an entry opening or mouth of the pocket 23. In the present case, the blank 10 is offset in relation to the entry side of the pocket 23, that is to say it forms a relatively long, bottom leg 27 and a shorter leg 28 above the pocket 23.

As it is pushed into the pocket 23, the blank 10 is positioned in a U-shaped manner against the group 19 of packs. The (longer) leg 27 is located on the underside, and the leg 28 is located on the top side, of the group 19 of packs. A transverse leg 29 forms the front side of the unit pushed into the pocket 23. During the pushing-in movement, the blank 10 detaches itself with slippage from the circumferential surface of the folding turret 21.

One special feature is the moveable design of boundaries of the pocket 23, namely pocket walls, in the region of the legs 27, 28, these boundaries being moved in the pushing-in direction in accordance with the pushing-in movement of the group 19 of packs and blank 10 so that there is no relative movement. The relevant pocket walls comprise endless conveyors, namely belts 30, 31. These can be carried along by the group 19 of packs and the blank 10 during the pushing-in operation. An independent drive of the belts 30, 31 is advantageous. In each case one conveying strand 32, 33, which is directed toward the pocket 23, forms a boundary of the pocket 23 or a pocket wall. The belts 30, 31 extend integrally over at least the entire width of the pocket 23. Transversely directed deflecting rollers 34, 35 for the belts 30, 31 are arranged on the entry side and opposite.

A further special feature is that the (single) pocket 23 of the folding turret 21 extends through the diameter of the folding turret 21, so that an exit station 36 of the same pocket 23 is formed opposite the pushing-in station 20. The folding turret 21 can be rotated cyclically through 180°, so that, once a group 19 of packs with blank 10 has been pushed into the pocket 23 and the folding turret 21 has been rotated, the relevant unit 10, 19 is located in the region of the exit station 36. The conveying means, namely belts 30, 31, extend over the entire length of the pockets 23, that is to say transversely and diametrically through the cylindrical folding turret 21.

A stop component 37 is arranged in the pocket 23 and can be moved within the pocket 23, namely from the side of the pushing-in station 20 to the opposite exit station 36. In the end positions of the stop component 37, transversely directed abutment surfaces 38, 39 are (approximately) flush with the circumference of the folding turret 21.

When a group 19 of packs with blank 10 is pushed in, the stop component 37, or the abutment surface 38 thereof, forms a supporting surface for the blank 10, to be precise for the transverse leg 29. The latter rests with a certain amount of pressure on the abutment surface 38. The pushing-in movement causes the stop component 37 to be displaced radially within the pocket 23, to be precise preferably in accordance with the movement of the belts 30, 31. The blank 10 is thus fixed in a friction-free manner on three sides of the group 19 of packs.

When the group 19 of packs has been pushed all the way into the pocket 23 (FIGS. 4 and 7), the correspondingly dimensioned stop component 37 is flush with the folding turret 21 in the region of the exit station 36. The folding turret 21 can then execute the rotary movement, to be precise in the counterclockwise direction. The end position is shown in FIG. 2. The article which is to be wrapped, namely the group 19 of packs, with blank 10 is located in the position for pushing out of the folding turret 21.

The stop component 37 performs a double function, that is to say it also causes the partially completed pack 11 to be pushed out of the folding turret 21. This pushing-out operation is accompanied by the next group 19 of packs being pushed in, the stop component 37 being displaced radially in the process. The abutment surface 39 causes the previous unit 19, 10 to be pushed out. For this purpose, the stop component 37 is of block form, namely cuboidal, with dimensions corresponding to the width and height of the interior of the pocket 23. In the longitudinal direction of the latter, the stop component 37 is dimensioned such that, in the respective end positions, a free space corresponding to the dimensions of an article which is to be wrapped is formed in the pocket 23.

According to a first embodiment, the stop component 37 is connected to the belts 30, 31, that is to say it is driven by the latter. On account of the rotary movement of the folding turret 21, the belts or the conveying strands 32, 33 and the stop component 37 always move in the same direction, namely from left to right, as seen in relation to FIG. 2.

In the case of the exemplary embodiment according to FIGS. 2 to 5, the movement is generated by a straightforward pushing gear mechanism. The stop component 37 is fastened on preferably two belts 30, 31 or conveying strands 32, 33 by means of transversely directed crossmembers 40, 41. The crossmembers 40, 41 have a (trapezoidal) depression on the side which is directed toward the conveying strand 32, 33. A clamping component 40, 41, which is connected to the stop component 37 on the top side, on the one hand, and on the underside, on the other hand, enters in a form-fitting manner into this depression. The belt 30, 31, or the conveying strand 32, 33 thereof, is deflected in the region of the crossmember 40, 41 and retained on a permanent basis in the recess or depression of the crossmember 40, 41 by the clamping component.

The drive power for moving the stop component 37 by way of the belts 30, 31 is transmitted (indirectly) via the crossmembers 40, 41. These crossmembers are connected, at their ends, to guides or a common carriage 43. The top crossmember 40 and the bottom crossmember 41 are fastened on the top side and underside of the carriage 43 in each case by way of an angled end leg.

The carriages 43, which are thus arranged on both sides, can be displaced back and forth in the longitudinal direction of the pocket 23. The carriages 43 are guided here with sliding action on carrying bars 44, 45. Two carrying bars 44, 45 extend one above the other, at a distance apart, in the longitudinal direction of the pocket 23.

Figure 5:
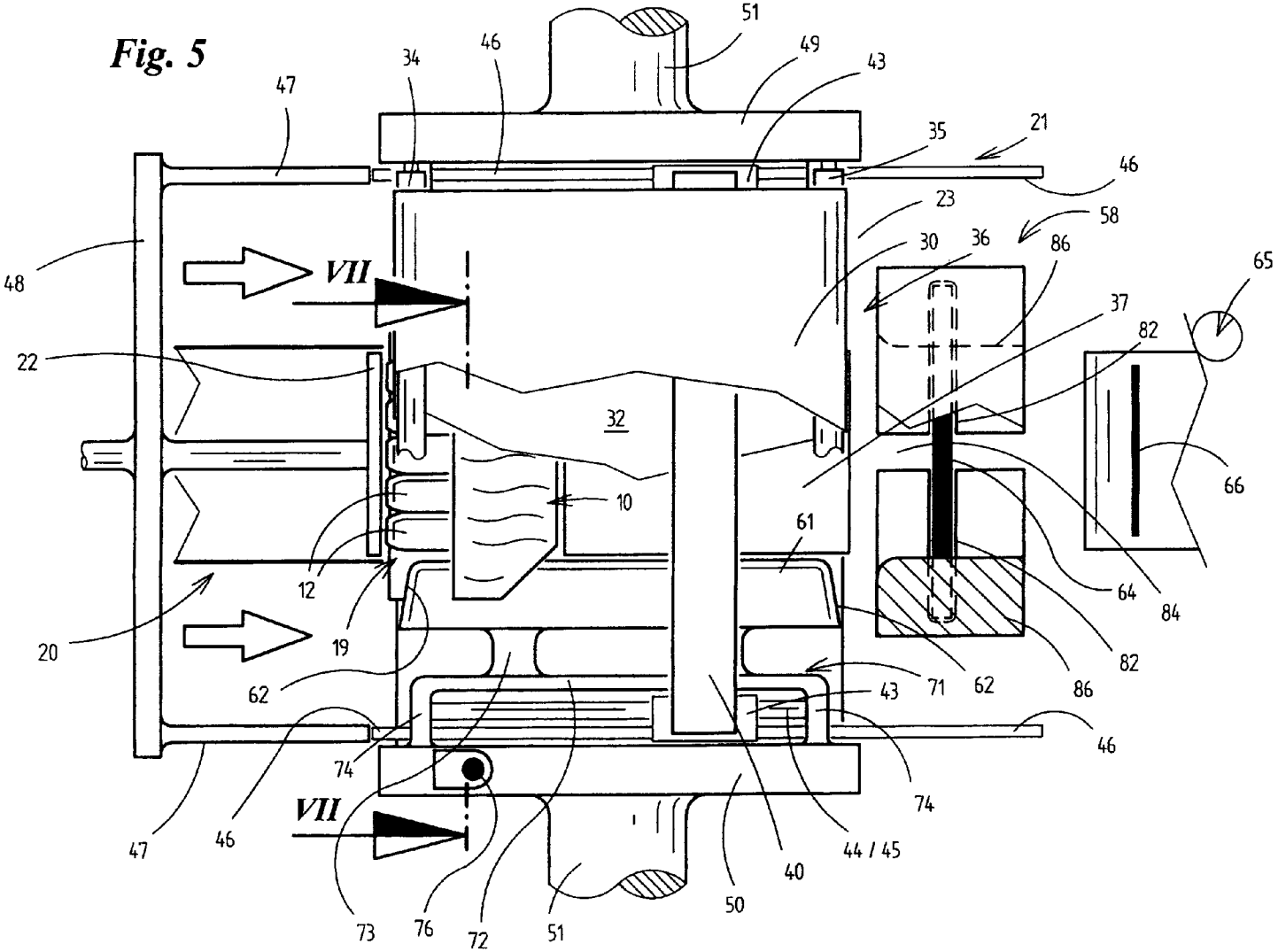
FIG. 5 shows the folding turret according to FIG. 4 in plan view and along horizontal section plane V-V from FIG. 4.

The drive power is transmitted by way of connecting rods 46 which likewise extend in the longitudinal direction of the pocket 23, to be precise on both sides and in the region of the carriages 43 in each case. The connecting rods 46 are fixed to the crossmembers 40, 41 and/or the carriages 43. In terms of length, the connecting rods 46 are dimensioned such that, in a starting position, they project out of the pocket 23 in each case (FIG. 5). For the purpose of displacing the moveable means, that is to say the stop component 37, and of moving the belts 30, 31, the two connecting rods 46 are subjected to pressure at the free ends and are displaced, in the longitudinal direction of the pocket 23, into the opposite end position. This movement is brought about by pushing means which are positioned in a stationary manner outside the pocket 23 or the folding turret 21 and are arranged in the region of the pushing-in station 20. The pushing means are push rods 47 which end up butting against the free ends of the connecting rods 46. The (two) push rods 47 are connected to a common transverse carrier 48, so that the two connecting rods 46 are always activated together and at the same time. The pusher 22, or a rod of the same, is also fitted on the transverse carrier 48, so that the operations of pushing the group 19 of packs in and actuating the connecting rods 46 always proceeds simultaneously. The connecting rods 46 pass out of the pocket 23 on the opposite side during the pushing movement. Following rotation of the folding turret 21, the connecting rods 46 resume their starting position, in which they are ready for actuation, to be precise once the unit comprising pusher 22 and push rods 47 has been drawn back.

The folding turret 21 can be rotated as a whole and, for this purpose, is connected to lateral, rotatable carrying components, namely carrying disks 49, 50. The entire folding turret 21, with means which are yet to be described, is arranged between these carrying disks 49, 50 (FIG. 5). The rotary drive power is transmitted to these carrying disks 49, 50, to be precise by way of a spindle or shaft 51.

Figure 6:
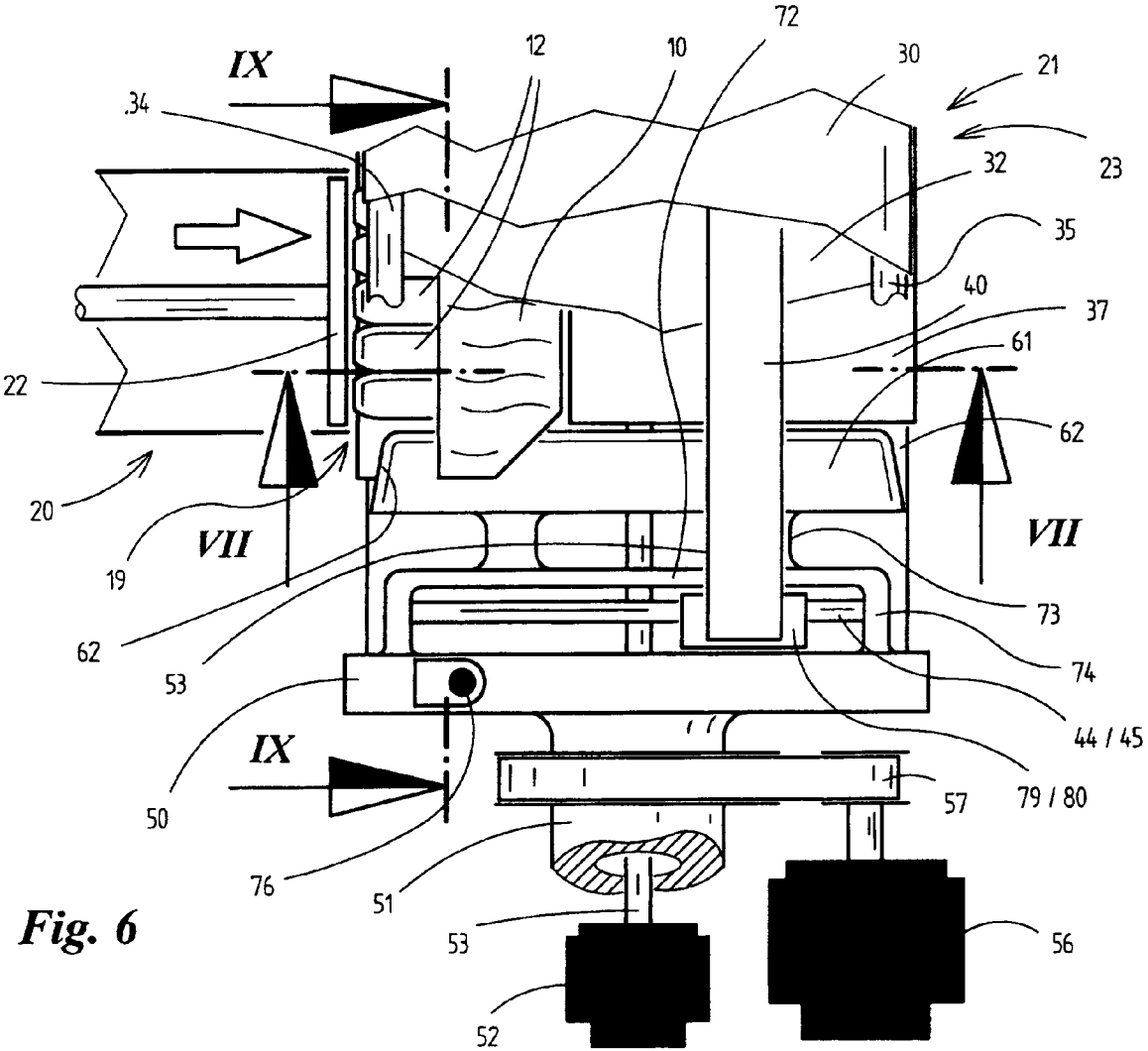
FIG. 6 shows an illustration corresponding to FIG. 5 for another exemplary embodiment of a folding apparatus.

According to an alternative which is shown in FIGS. 6, 7 and 9, the drive power is transmitted directly to the stop component 7 and, from the latter, to the belts 30, 31. A drive motor, to be precise a servodrive 52, is connected for transmission purposes to the stop component 37 via a drive shaft 53. The rotary movements of the latter are transmitted, by a pinion, to a toothing arrangement 55, which is connected to the stop component 37, in order to produce a back and forth movement. The pinion 54 and (rectilinear) toothing arrangement 55 are provided within the stop component 37, which is designed as a hollow body. The pinion 54 is mounted in a stationary manner in a central position in relation to the folding turret 21. Rotary movement of the pinion causes the stop component 37 to be displaced in a corresponding direction. The drive shaft 53 extends centrally within the shaft 51, designed as a hollow shaft, for the rotary movement of the folding turret 21. In the case of this exemplary embodiment, the shaft 51 is likewise driven in rotation by a servodrive 56, via a toothed belt 57. On account of the movement sequences outlined, the pinion 54 is always driven in one direction for the purpose of moving the stop component 37 from one end position into the other.

Figure 10:
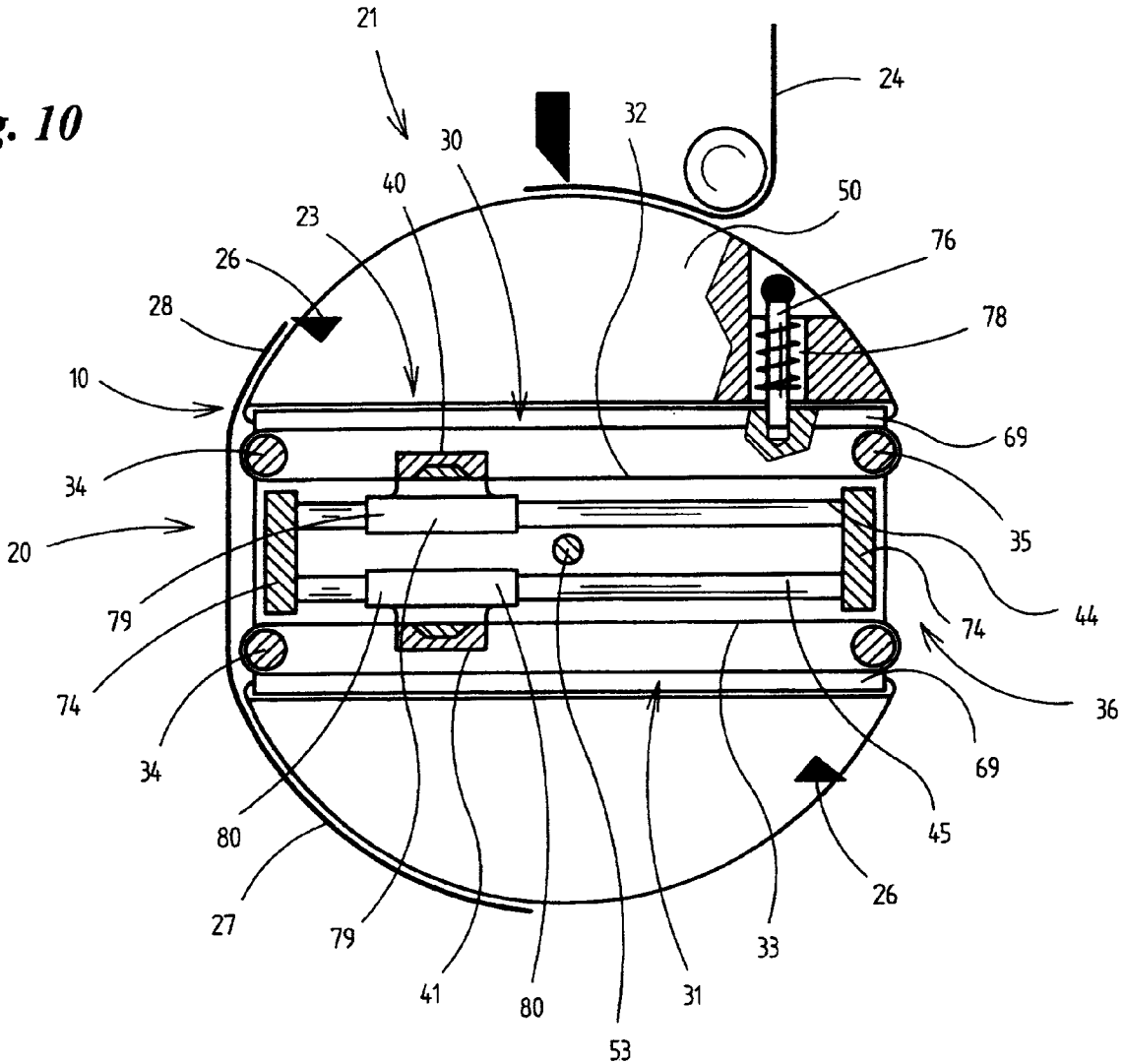
FIG. 10 shows a detail-specific illustration for the exemplary embodiment according to FIG. 9, along vertical section plane X-X.
Figure 11:
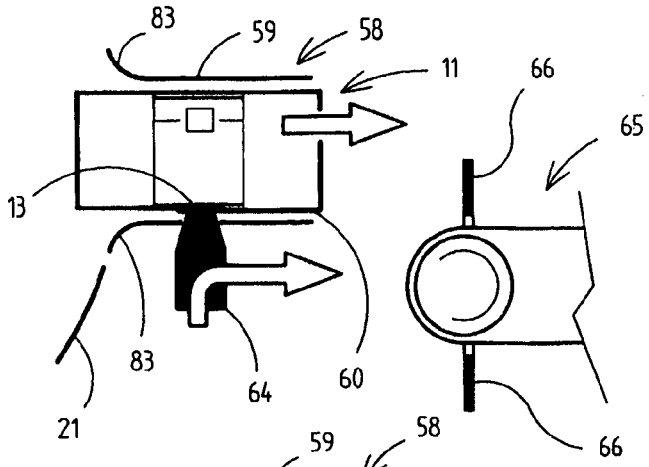
FIG. 11 shows a side view of a detail of the apparatus according to FIG. 4 in the region where packs are transferred to a removal conveyor.
Figure 12:
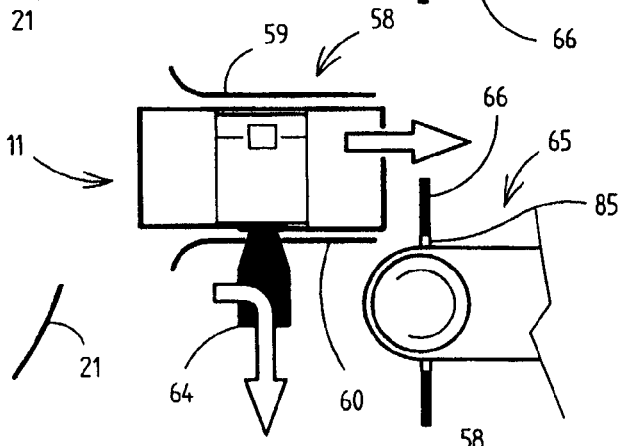
FIGS. 12 and 13 show illustrations corresponding to FIG. 11 with the pack in different positions.

The drive shaft 53 runs centrally in relation to the carriage 43. In the case of this exemplary embodiment, this carriage is thus divided into two sub-carriages 79, 80, which can each be displaced on a carrying bar 44, 45. The drive shaft 53 extends through between the sub-carriages 79, 80 (FIGS. 9 and 10).

Figure 4:
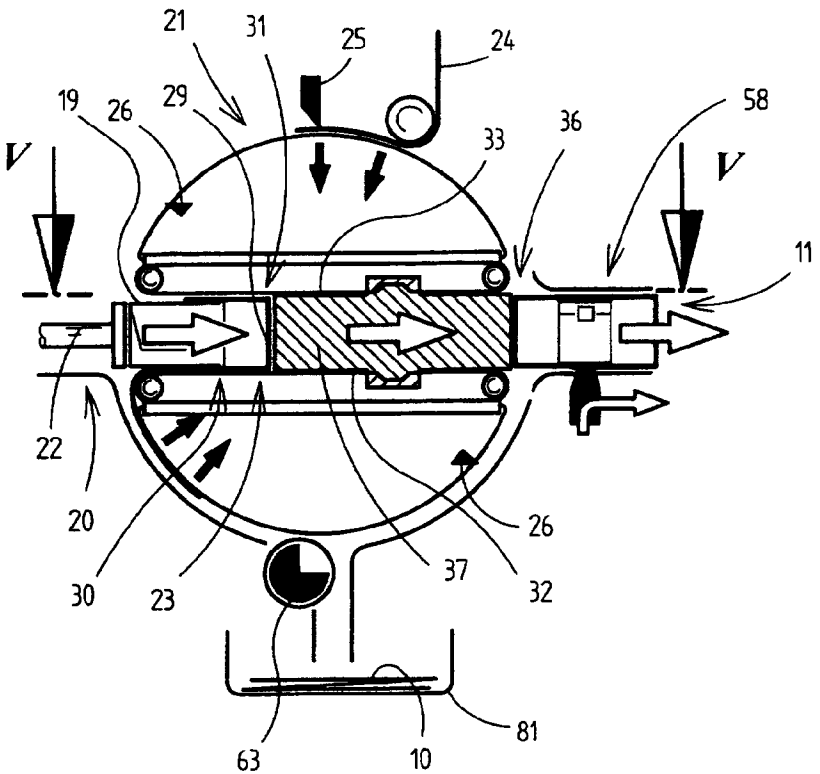
FIG. 4 shows the detail according to FIG. 3 in yet another position.
Figure 3:
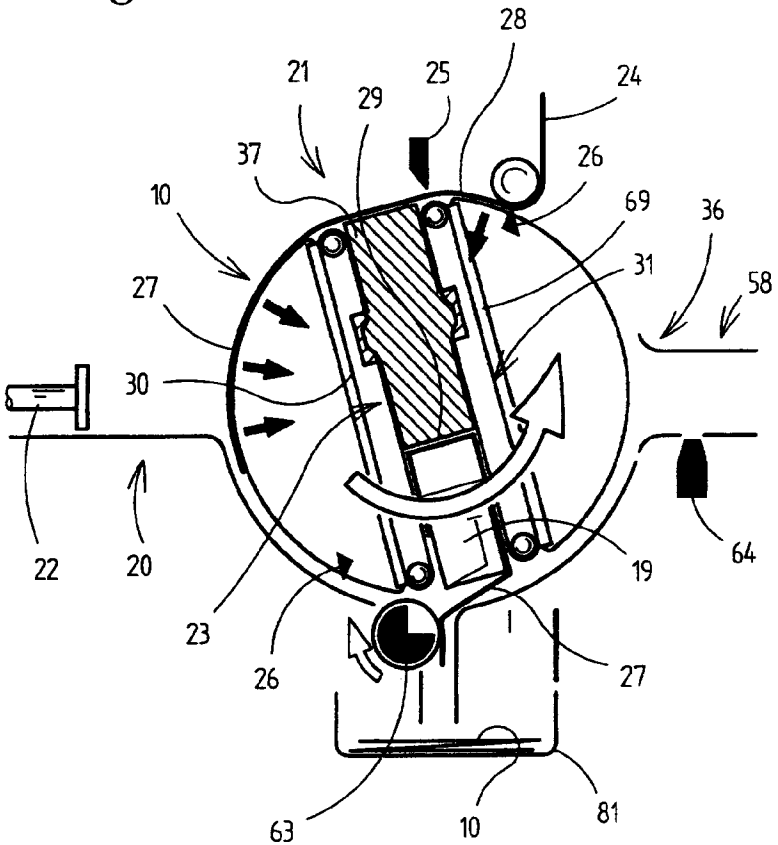
FIG. 3 shows a detail of the apparatus according to FIG. 2, namely a folding turret, in a different position.

When the article or the group 19 of packs is pushed into the pocket 23, offset relative positioning on the circumference of the folding turret 21 causes the blank 10 to be positioned around the group 19 of packs such that the inner leg 28 of the blank 10 rests on the top side of the group 19 of packs (FIG. 4). The rotary movement of the folding turret 21 begins as the relatively long leg 27 is still butting, in part, against the circumference of the folding turret 21. It is only once rotation has been completed that the leg 27 is folded around a rear side, as seen during the operation of pushing the group 19 of packs in, until it butts against the leg 28. The longitudinal overlap 13 or flexible-tube fold is thus formed on the underside of the group 19 of packs, to be precise as the unit is pushed out of the pocket 23 into a shaft-like mouthpiece 58 which follows the folding turret 21 and has a top wall 59 and bottom wall 60 (FIGS. 2, 4 and 11-14).

Further folding flaps are formed as the group 19 of packs with blank 10 is moved diametrically through the folding turret 21. As the group 19 of packs with blank 10 is pushed in, the upright side flap 15 at the front, as seen in the pushing-in direction, is folded into abutment against an outer bag pack 12 by an obliquely directed folding surface 62 of the side component 61 of a stationary folding means, namely a side component 61 for binding the pocket 23, or the interior of the same, laterally. The side flap 16 located opposite, this side flap being located at the front following rotation of the folding turret 21, is folded by lateral folding means in the region of the mouthpiece 58 as the unit is pushed out of the pocket 23.

One special feature is constituted by a means for tensioning the blank 10 on the folding turret 21 and/or as it is pushed into the pocket 23. For this purpose, a tensioning means, to be precise a rotationally driven suction roller 63, is arranged on the underside of, or beneath, the folding turret 21. This suction roller grips a peripheral or end region of the blank 10, to be precise the leg 27. The suction roller 63 is driven in the opposite direction and winds part of the blank 10 over the circumference. When the blank 10 is drawn off during the pushing-in movement, a smoothing tensioning action is transmitted to the blank 10.

A further special feature is that the suction roller 63 removes any defective blanks or removes blanks 10 if there are no articles available for wrapping. In this case, the relevant blank 10 is gripped by the suction roller 63 (FIG. 2) and conveyed away in its entirety into a collecting container beneath the folding turret 21.

The partially folded packs 11 pushed out of the folding turret 21 are processed in the region of the mouthpiece 58 by virtue of folding flaps being sealed. The downwardly directed longitudinal overlap 13 is sealed by an upwardly moveable sealing means or by a sealing jaw 64. The latter passes through an opening 82 in the bottom wall 60.

The task of transferring the packs 11 to a removal conveyor or pack conveyor 65 is achieved in a particular manner with the aid of the mouthpiece 58. The latter can be displaced in the conveying direction with the pack 11. In a receiving position (FIGS. 2 and 11), the mouthpiece 58 is directed toward the folding turret 21 or the exit station 36. The pack 11 is pushed directly out of the pocket 23 into the awaiting mouthpiece 58. This operation is ensured by inlet curves 83 of the top wall 59 and bottom wall 60. The sealing jaw 68 is located beneath the opening 82. Once the pack 11 has been received in the mouthpiece 58 (FIGS. 11 and 12), the sealing jaw 68 is moved upward. The longitudinal overlap 13 is located in the region of the opening 82, and thus in the region of the sealing jaw 64, and is then sealed. The sealing jaw 64 is moved in the conveying direction synchronously with the mouthpiece 58.

Figure 13:
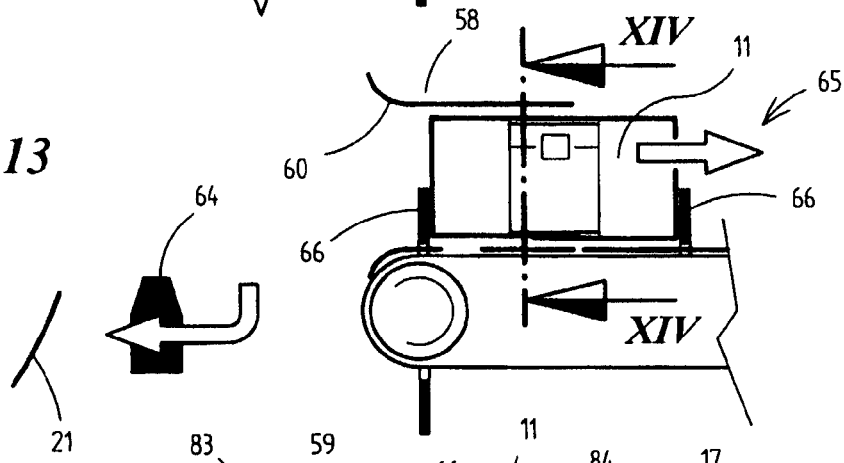
Figure 14:
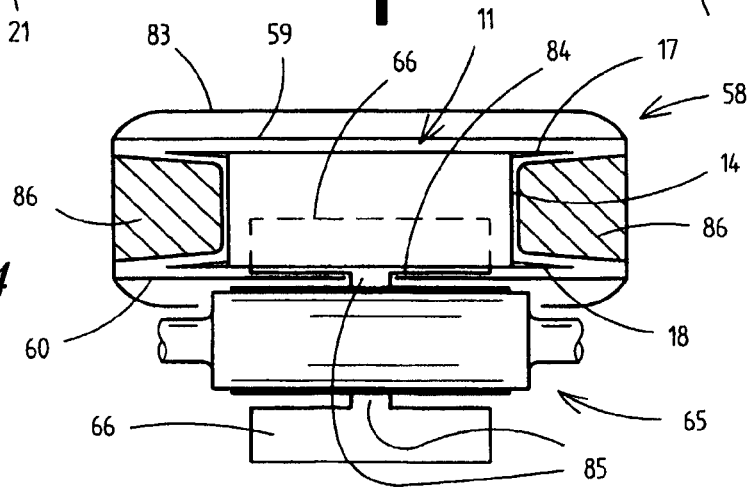
FIG. 14 shows the detail according to FIG. 13 in cross section, namely along section plane XIV-XIV from FIG. 13.

Prior to an end or transfer position of the mouthpiece 58 being reached in the initial region of the pack conveyor 65, the sealing jaw 68 is moved downward (FIG. 12) and, in a bottom position, moves back into the starting position (FIG. 13). For precise transfer of the pack 11, the mouthpiece 58 enters in the region of the pack conveyor 65 such that the pack 11 is received precisely between two successive carry-along elements 66. The bottom wall 60 here extends immediately above a top strand of the pack conveyor 65 (FIG. 13). The bottom wall 60 and the carry-along elements 66 are coordinated with one another in terms of shaping such that the means can be moved past one another, so that the pack 11 is pushed out of the mouthpiece 58 by the carry-along element 66 at the rear in each case and conveyed away. For this purpose, the bottom wall 60 is provided with a central aperture or a slot 84. A connecting crosspiece 85 of the carry-along element 66 enters into this slot during the pushing-out movement of the pack 11 (FIG. 14).

For precise guidance of the pack 11, the mouthpiece 58 has lateral guide means, namely guide components 86, which butt against the sideways directed end sides 14 and also guide the top and bottom longitudinal flaps 17, 18, which are still directed sideways at this point in time. The front side flap 16, as seen in the movement direction, is also folded by the guide components 86.

The pack conveyor 65 is designed as an endless belt with carry-along elements 66 which grip the packs 11 on the front and rear sides.

As the packs 11 are transported by the pack conveyor 65, they run through a folding station with so-called folding diverters 67. The latter fold the longitudinal flaps 17 and 18 one after the other against the sideways directed pack surfaces. Following the folding diverter 67, the packs 11 pass into the region of a further sealing station with lateral sealing jaws 68. These serve for sealing the envelope fold 15, 16, 17, 18 on the sideways directed pack surfaces.

A further special feature is the configuration of the folding apparatus to provide for straightforward adaptation to different formats. In respect of the means which have to be adapted for a format change, the folding turret 21 can be exchanged as a unit. For this purpose, mounts on which the exchangeable parts of the folding turret 21 are fitted are arranged in the lateral carrying means, namely carrying disks 49, 50. These mounts are disk-like carrying components 69 which are mounted on the inside of the carrying disks 49, 50 such that they can be removed, that is to say such that they can be displaced in an axis-perpendicular direction. The carrying components 69 are seated (in a flush manner) in recesses 70 of the carrying disks 49, 50 and can be guided out of these recesses 70 by displacement. The belts 30, 31, namely the deflecting rollers 34, 35 thereof, are fitted on the carrying components 69. Furthermore, a respective carrying framework for further means, namely a carrying bracket 71 which is U-shaped in plan view, is connected to the carrying components 69. Means which bound the pocket 23 laterally, namely side components 61, are fastened by means of carrying bolts 73 on a crosspiece 72 of the carrying bracket 71, this crosspiece running in the longitudinal direction of the pocket 23. On the one hand, the carrying bars 44, 45 for the sliding gear mechanism of the crossmembers 40, 41 are mounted in transversely directed legs 74 of the carrying bracket 71. On the other hand, in the case of the configuration according to FIG. 6, the connecting rod 46 is mounted in a displaceable manner in each case in the two crosspieces 72. By means of the carrying components 69, the carrying brackets 71 and thus the entire pocket 23 of the folding turret 21 are removed from the folding turret 21 as a cohesive unit in the event of a necessary changeover and replaced by an identical or similar unit. For this exchange, the drive shaft 53 for the pinion 54 is provided with a coupling 75 in the region of the carrying component 69.

The exchangeable unit of the folding turret 21 is secured (mechanically) in the operating position. As is shown in FIG. 10, a latching bolt 76 enters into a depression 77 of the carrying component 69. The spring-loaded latching bolt 76 is seated in a bore 78 of the carrying disk 50. In order to exchange a folding turret 21, or the format-dependent parts, the latching bolt 76 is drawn (manually) out of the latching position. The carrying components 69 can then be moved out of connection with the carrying disks 48, 49.

List of designations

| | |
|---|---|
| 10 | Blank |
| 11 | Pack |
| 12 | Bag pack |
| 13 | Longitudinal overlap |
| 14 | End side |
| 15 | Side flap |
| 16 | Side flap |
| 17 | Longitudinal flap |
| 18 | Longitudinal flap |
| 19 | Group of packs |
| 20 | Pushing-in station |
| 21 | Folding turret |
| 22 | Pusher |
| 23 | Pocket |
| 24 | Material web |
| 25 | Severing cutter |
| 26 | Mating cutter |
| 27 | Leg |
| 28 | Leg |
| 29 | Transverse leg |
| 30 | Belt |
| 31 | Belt |
| 32 | Conveying strand |
| 33 | Conveying strand |
| 34 | Deflecting roller |
| 35 | Deflecting roller |
| 36 | Exit station |
| 37 | Stop component |
| 38 | Abutment surface |
| 39 | Abutment surface |
| 40 | Crossmember |
| 41 | Crossmember |
| 42 | Clamping component |
| 43 | Carriage |
| 44 | Carrying bar |
| 45 | Carrying bar |
| 46 | Connecting rod |
| 47 | Push rod |
| 48 | Transverse carrier |
| 49 | Carrying disk |
| 50 | Carrying disk |
| 51 | Shaft |
| 52 | Servodrive |
| 53 | Drive shaft |
| 54 | Pinion |
| 55 | Toothing arrangement |
| 56 | Servodrive |
| 57 | Toothed belt |
| 58 | Mouthpiece |
| 59 | Top wall |
| 60 | Bottom wall |
| 61 | Side component |
| 62 | Folding surface |
| 63 | Suction roller |
| 64 | Sealing jaw |
| 65 | Pack conveyor |
| 66 | Carry-along element |
| 67 | Folding diverter |
| 68 | Sealing jaw |
| 69 | Carrying component |
| 70 | Recess |
| 71 | Carrying bracket |
| 72 | Crosspiece |
| 73 | Carrying bolt |
| 74 | Leg |
| 75 | Coupling |
| 76 | Latching bolt |
| 77 | Depression |
| 78 | Bore |
| 79 | Sub-carriage |
| 80 | Sub-carriage |
| 81 | Collecting container |
| 82 | Opening |
| 83 | Inlet curve |

-continued

| List of designations | |
|---|---|
| 84 | Slot |
| 85 | Connecting crosspiece |
| 86 | Guide component |

The invention claimed is:

1. An apparatus for wrapping articles with a blank (10), the articles being packs (12) or groups (19) of packs, the apparatus comprising:

a rotatable folding turret (21) having an outer circumference, a pocket (23) having a width and a height and extending radially through the turret (21), the pocket (23) being open at both sides and having entry openings into which the articles and the blank (10) can be pushed and fed through the folding turret (21) in a radial direction, belts (30, 31) being arranged in the pocket (21), the belts (30, 31) having conveying strands (32, 33) that direct the articles horizontally, with one of the belts (30) directing a top side of the article and another one of the belts (31) directing an underside of the article, wherein the conveying strands (32, 33) can fix top and bottom legs (27, 28) regions of the blank (10) on the article during the pushing-in movement, and a movable stop component (37) comprising abutment surfaces (38, 39), the stop component (37) being contained within the pocket (23) and being connected to the conveying strands (32, 33) of the belts (30, 31), wherein:

a) the blank (10) is held ready on the outer circumference of the folding turret (21) such that one of the entry openings of the pocket (23) is covered by the blank (10), b) the article impinges the blank (10) during the pushing-in movement into the pocket (23), with the blank (10) being folded in a U-shape around the article, c) the stop component (37) fills a sub-region of the pocket (23) and extends over the width and height of the pocket (23), d) when entering the pocket (23) the article presses the blank (10) with a front surface area, relative to the direction of movement, against one of the abutment surfaces (38, 39) of the stop component (37), e) the stop component (37) is movable within the pocket (23) between two end positions at which a respective one of the abutment surfaces (38, 39) is flush with one of the entry openings of the pocket (23), and f) the stop component (37) is driven whereby the drive of the stop component (37) is transmitted to the belts (30, 31) such that the belts (30, 31) are moved by the stop component (37).

2. The apparatus as claimed in claim 1, characterized in that the conveying means are driven separately from, or independently of, the pushing-in movement of the article.

3. The apparatus as claimed in claim 1, wherein:

the blank (10) is severable from a material web (24), the material web (24) is fed to a circumferential surface on the outer circumference of the folding turret (21), the material web (24) is severed from the material web (24) in an appropriate position relative to one of the entry opening of the pocket (23), wherein a peripheral or end region of the blank (10) is subjected to an action of a stationary tensioning suction roller (63) that is rotated in a direction opposite that of the folding turret (21) adjacent to the circumference of the folding turret (21).

4. The apparatus as claimed in claim 3, wherein the suction roller (63) discharges defective blanks into a collecting container.

5. The apparatus as claimed in claim 1, wherein the pocket (23)is bounded laterally by side components (61) having a folding surface (62), each of the side components (61) being assigned to one of the entry openings of the pocket (23) and, as an article with blank (10) is pushed into the pocket (23), the folding surface (62) folds a front, upright side flap (15) of the blank (10).

6. The apparatus as claimed in claim 1, further comprising a mouthpiece (58) having a top wall (59) and a bottom wall (60), the mouthpiece (58) being aligned with the pocket (23) and located an exit station (36) for receiving one of the articles once it has been pushed out of the pocket (23), wherein longitudinal overlap (13) of the folded blank (10) are sealed by a sealing means (64) in the region of the mouthpiece (58).

7. The apparatus as claimed in claim 6, wherein the mouthpiece (58) is movable back and forth between the folding turret (21) and a pack conveyor (65) as an intermediate conveyor for transferring the articles to the pack conveyor (65), wherein the articles are introduced into the mouthpiece (58) in a receiving position, in which the mouthpiece (58) is directed toward the folding turret (21) or the pocket (23), and for the mouthpiece (58) to be transported in the conveying direction into the region of the pack conveyor (65) wherein, in the position in which the mouthpiece is directed toward the pack conveyor (65), carry-along elements (66) of the pack conveyor (65) are introduced into the mouthpiece (58) in order to transport the articles out of the mouthpiece (58).

8. The apparatus as claimed in claim 7, wherein the longitudinal overlap (13) is sealable in the region of the mouthpiece (58), wherein a sealing jaw (64) sealing means is arranged outside the mouthpiece (58) and is movable through an opening (82) in the bottom wall (60) of the mouthpiece (58) until it butts against the article.

9. The apparatus as claimed in claim 8, wherein the sealing jaw (64) is movable in the conveying direction with the mouthpiece (58) at least in a sealing position, and is movable back into a starting position outside the mouthpiece (58).

10. The apparatus as claimed in claim 1, wherein the belts (30, 31) and/or side components (61 ) are connected to a lateral, rotatable mount comprising rotatable carrying disks (49, 50), the belts (30, 31) and/or the side components (61) being arranged in a removable manner on the carrying disks (49, 50).

11. The apparatus as claimed in claim 10, further comprising carrying components (69) arranged in a removable manner on the carrying disks (49, 50), the belts (30, 31) or the side components (61) being fitted on the carrying components (69) on both sides, and wherein these carrying components (69) are displaceable in an axis-perpendicular direction relative to the carrying disks (49, 50).

12. The apparatus as claimed in claim 10, further comprising a carrying bracket (71) fitted on the carrying disks (49, 50) or on the carrying components (69) as a retaining means, the side components (61) being connected to a longitudinally running crosspiece (72), and carrying bars (44, 45) for a carriage (43) being connected to transversely directed legs (74) of the carrying bracket (71).

13. The apparatus as claimed in claim 1, further comprising lateral guides and crossmembers (40, 41), the lateral guides comprising a carriage (43) running on carrying bars (44, 45), wherein the stop component (37) is connected to the carriage (43) of the lateral guides via the crossmembers, and wherein the crossmembers (40, 41) are fitted respectively on a top side and an underside of the stop component (37), whereby the crossmembers connect the stop component (37) to the conveying strands (32, 33) and to the carriage (43).

14. The apparatus as claimed in claim 13, wherein the stop component (37)is movable back and forth within the pocket (23) between the end positions by a pushing gear mechanism, wherein the carriage (43)is attached to a connecting rod (46) that extends in the movement direction of the stop component (37) and is displaceable in the longitudinal direction of the pocket (23), with the carriage (43) being moved by push rods (47) arranged outside the pocket (23).

15. The apparatus as claimed in claim 14, further comprising a pusher (22) for pushing the articles into the pocket (23), wherein two of the push rods (47), laterally arranged relative to each other, and the pusher (22) are fitted on a common transverse carrier (48) to form a pushing unit.

16. The apparatus as claimed in claim 1, further comprising a toothed gear mechanism with a rack (55) and pinion (54) for driving the stop component (37) between the end positions, wherein the stop component (37)is a hollow body, and the rack (55) and pinion (54) being arranged within the hollow stop component (37).

17. The apparatus as claimed in claim 16, wherein the pinion (54) is arranged along an axis of rotation of the folding turret (21) and is rotated by a drive shaft (53) that runs within a hollow central drive shaft (51) for the folding turret (21).

* * * * *